US007794289B1

(12) United States Patent
Chen et al.

(10) Patent No.: US 7,794,289 B1
(45) Date of Patent: Sep. 14, 2010

(54) CIRCUIT BOARD CONNECTOR ASSEMBLY

(75) Inventors: Chung-Yu Chen, Tu-Cheng (TW); Sheng-Nan Yu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/453,196

(22) Filed: May 1, 2009

(51) Int. Cl.
*H01R 13/00* (2006.01)

(52) U.S. Cl. ..... 439/682; 439/857

(58) Field of Classification Search ..... 439/682, 439/857, 620.29, 620.3, 736
See application file for complete search history.

(56) References Cited

U.S. PATENT DOCUMENTS 3,517,376 A * 6/1970 Larsen et al. ..... 439/70
5,330,372 A * 7/1994 Pope et al. ..... 439/692
6,672,907 B2 * 1/2004 Azuma ..... 439/682
6,926,563 B2 * 8/2005 Morana et al. ..... 439/682
6,932,658 B2 * 8/2005 Liang ..... 439/816
7,118,423 B2 * 10/2006 Kobayashi et al. ..... 439/682
7,182,635 B2 * 2/2007 Huang ..... 439/541

* cited by examiner

*Primary Examiner*—Hien Vu
(74) *Attorney, Agent, or Firm*—Rosenberg, Klein & Lee

(57) ABSTRACT

A circuit board connector assembly includes two receptacle connectors each including a receptacle insulating housing and a plurality of receptacle terminals disposed in the receptacle insulating housing, and a plug connector disposed on the top of two adjacent receptacle connectors. Each of the receptacle terminals has a base board. Two opposite side edges of the base board extend towards a same direction to form a pair of clamping portions. The plug connector includes a plug insulating housing and a plurality of plug terminals integrated in the plug insulating housing. Each of the plug terminals has a connecting board molded in the plug insulating housing. Two opposite ends of the connecting board extend towards a same direction to form a pair of contact arms extending beyond a mating surface of the plug insulating housing to be electrically clamped by the corresponding two pairs of clamping portions of the two receptacle connectors.

5 Claims, 4 Drawing Sheets

CIRCUIT BOARD CONNECTOR ASSEMBLY

BACKGROUND OF THE INVENTION

1. Field of the Invention

The present invention generally relates to a connector assembly, and more particularly to a circuit board connector assembly.

2. The Related Art

A conventional circuit board connector assembly includes a plug connector and a receptacle connector. The plug connector includes a plug insulating housing and a plurality of plug terminals disposed in the plug insulating housing and soldered with a male printed circuit board. The receptacle connector includes a receptacle insulating housing and a plurality of receptacle terminals disposed in the receptacle insulating housing and soldered with a female printed circuit board. When the plug connector is mated with the receptacle connector, the plug terminals are inserted into the receptacle insulating housing for electrically connecting the corresponding receptacle terminals so as to form an electrical connection between the two printed circuit boards.

However, when the circuit board connector assembly is broken, no matter the problem is checked out from the receptacle connector or the plug connector, the printed circuit board must be firstly disassembled from the corresponding connector so as to facilitate the connector to be repaired. So the repairing process is relative complex due to both the receptacle connector and the plug connector being soldered with the printed circuit boards.

SUMMARY OF THE INVENTION

An object of the present invention is to provide a circuit board connector assembly. The circuit board connector assembly includes two receptacle connectors and a plug connector disposed on the top of two adjacent receptacle connectors. Each of the receptacle connectors includes a receptacle insulating housing and a plurality of receptacle terminals disposed in the receptacle insulating housing. Each of the receptacle terminals has a base board and two opposite side edges of the base board extend towards a same direction to form a pair of clamping portions facing each other. The plug connector includes a plug insulating housing and a plurality of plug terminals integrated in the plug insulating housing. Each of the plug terminals has a connecting board molded in the plug insulating housing. Two opposite ends of the connecting board extend towards a same direction to form a pair of contact arms spaced from each other and extending beyond a mating surface of the plug insulating housing to be electrically clamped by the corresponding two pairs of clamping portions of the two receptacle connectors.

As described above, each of the plug terminals of the plug connector has a pair of contact arms electrically connecting corresponding two pairs of clamping portions of the two receptacle connectors so that the plug connector need not to be soldered with the printed circuit board. When the circuit board connector assembly is broken, if the problem is checked out from the plug connector, the circuit board connector assembly can be easily repaired due to the plug connector without the printed circuit board soldered thereon so that simplifies repairing process.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
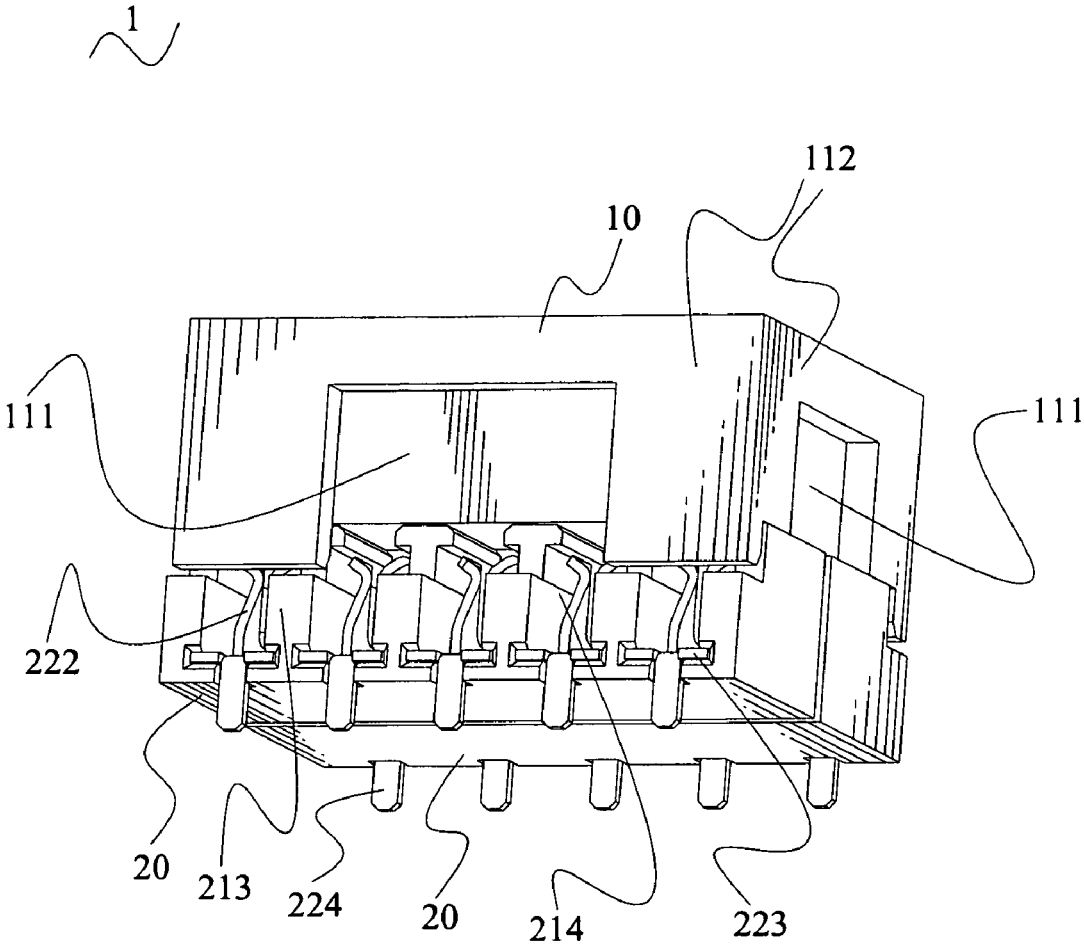
FIG. 1 is a perspective view of a circuit board connector assembly according to the present invention.

With reference to FIG. 1, a circuit board connector assembly 1 according to the present invention is shown. The circuit board connector assembly 1 includes a plug connector 10 and two receptacle connectors 20 mated with the plug connector 10. The circuit board connector assembly 1 is adapted for connecting two printed circuit boards (not shown).

Figure 2:
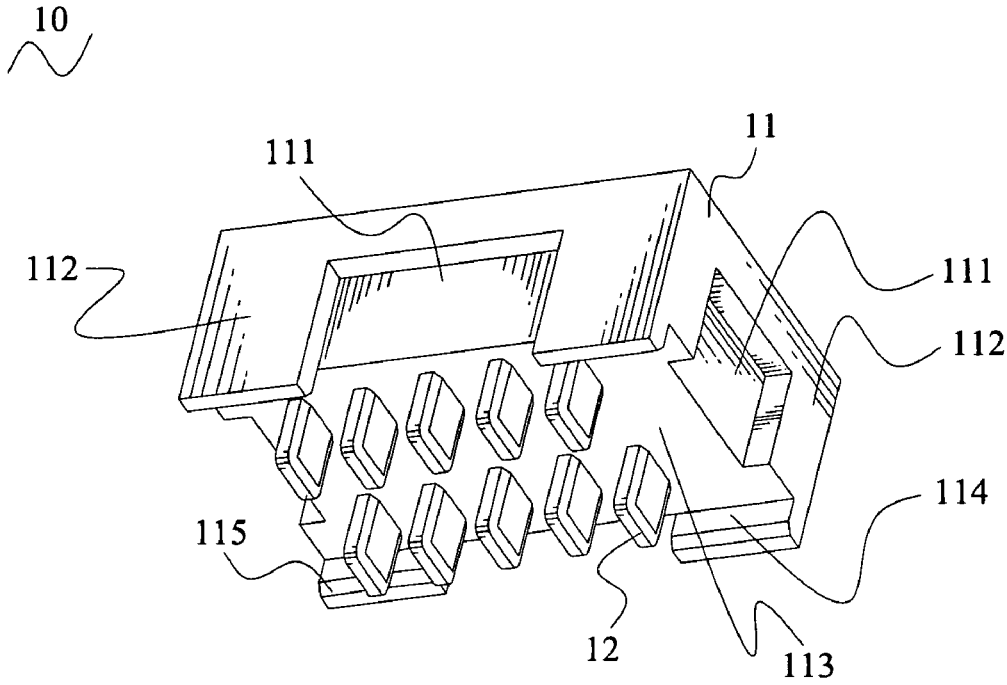
FIG. 2 is a perspective view of a plug connector of the circuit board connector assembly of FIG. 1.

With reference to FIG. 2, the plug connector 10 includes a plug insulating housing 11 and a plurality of plug terminals 12 integrated in the plug insulating housing 11. The plug insulating housing 11 is of rectangular structure and is provided with four rectangular assisting fillisters 111 at four side surfaces 112 thereof to penetrate through a mating surface 113 thereof, respectively. Each of two opposite side edges of the mating surface 113 of the plug insulating housing 11 extend downward to form a pair of buckling portions 114 spaced away from each other. An inner bottom corner of each of the buckling portions 114 defines a slope 115.

Figure 3:
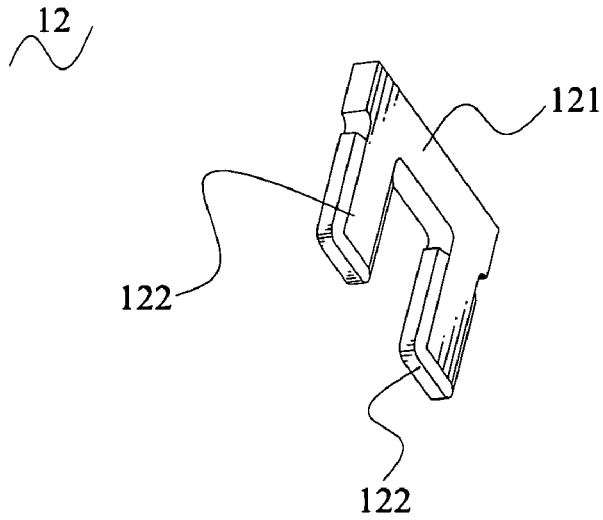
FIG. 3 is a perspective view of a plug terminal of the plug connector of FIG. 2.

Referring to FIG. 3, each of the plug terminals 12 has a bar-shaped connecting board 121. Two opposite ends of the connecting board 121 extend towards a same direction to form a pair of contact arms 122 spaced from each other.

Referring to FIG. 2 and FIG. 3 again, the plug terminals 12 and the plug insulating housing 11 are fabricated as a single molded component, and the plug terminals 12 are arranged at regular intervals along a longwise direction of the plug insulating housing 11 and parallel to one another. The connecting board 121 is molded in the plug insulating housing 11 and the contact arms 122 project out of the mating surface 113 of the plug insulating housing 11. So the contact arms 122 look like being divided into two rows along the longwise direction of the plug insulating housing 11.

Figure 4:
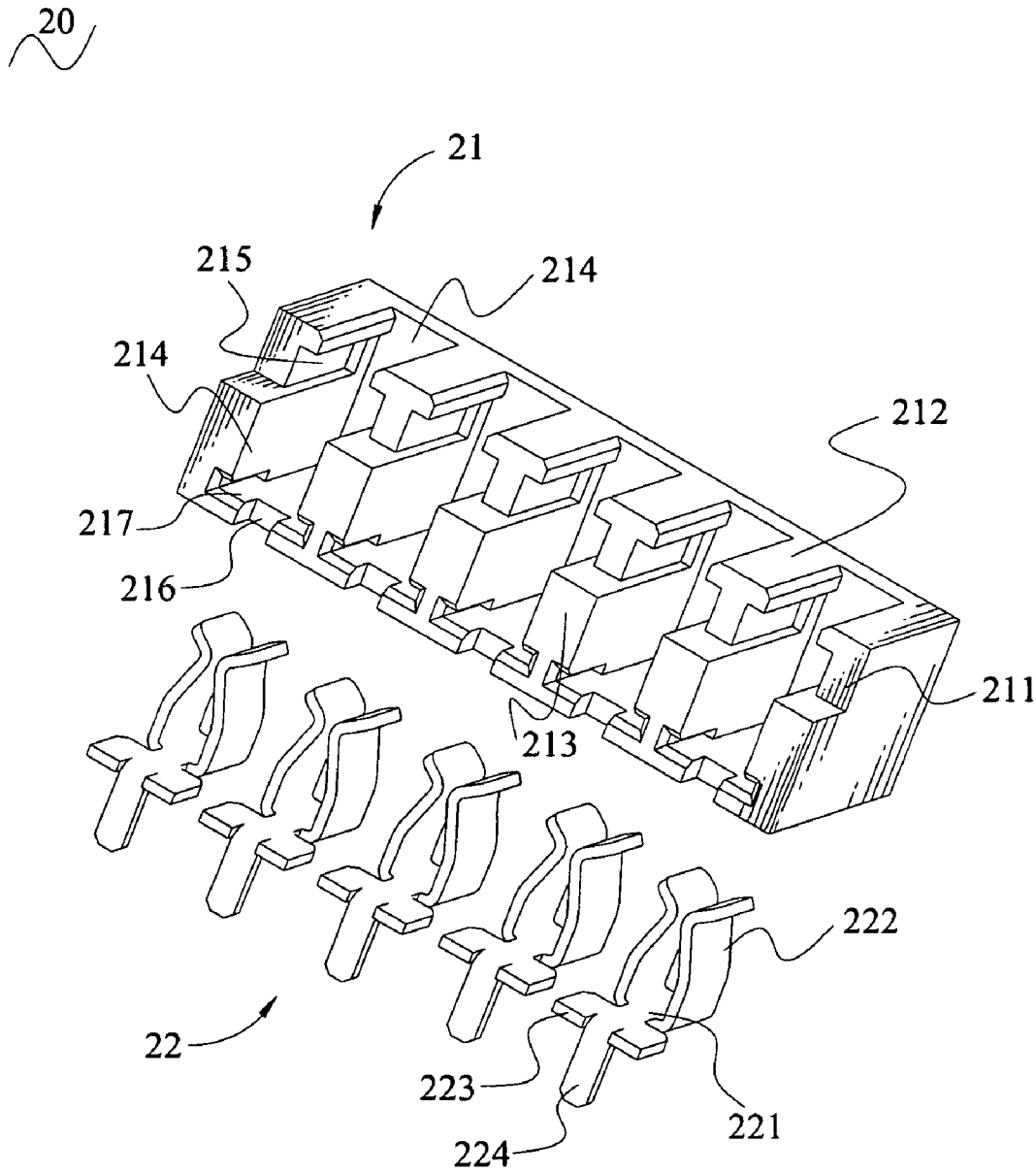
FIG. 4 is an exploded view of a receptacle connector of the circuit board connector assembly of FIG. 1.

Referring to FIG. 4, each of the receptacle connectors 20 includes a receptacle insulating housing 21 and a plurality of receptacle terminals 22 disposed in the receptacle insulating housing 21. The receptacle insulating housing 21 is substantially of rectangular structure, and defines an inserting groove 211 extending along a longwise direction thereof and located at the junction of a mating surface 212 and a corresponding side surface 213 thereof. The receptacle insulating housing 21 further defines a plurality of rectangular receiving cavities 214 arranged at regular intervals along the longwise direction thereof, and penetrating through the mating surface 212 and the side surface 213 thereof to communicate with the inserting groove 211. A top of each of the receiving cavities 214 oppositely extends toward two sides to form a pair of holding troughs 215 communicating with the inserting groove 211. A bottom of each of the receiving cavities 214 defines a holding gap 216 passing through a bottom surface of the receptacle insulating housing 21. The bottom of the receiving cavity 214 oppositely extends toward two sides to form a pair of fixing grooves 217 higher than the corresponding holding gap 216 and adjacent to two opposite sides of the corresponding holding gap 216. The holding gap 216 and the fixing groove 217 further penetrate through the side surface 213 of the receptacle insulating housing 21 to communicate with the outside.

Referring to FIG. 4 again, each of the receptacle terminals 22 has a rectangular flat base board 221. Two opposite side edges of the base board 221 extend towards a same direction to form a pair of clamping portions 222 facing each other and perpendicular to the base board 221. The clamping portions 222 are further face-to-face arched to approach each other. A pair of fixing portions 223 is oppositely protruded from the two opposite side edges of the base board 221 and adjacent to the clamping portions 222. A free end of the base board 221 extends towards an opposite direction to the clamping portions 222 to form a soldering portion 224 adjacent to the fixing portions 223.

Referring to FIG. 1 and FIG. 4, when the receptacle connector 20 is assembled, the base board 221 of the receptacle terminal 22 is received in the bottom of the corresponding receiving cavity 214 of the receptacle insulating housing 21. The pair of clamping portions 222 is also received in the corresponding receiving cavity 214 and free ends thereof are held at the two holding troughs 215 respectively. The soldering portion 224 is fastened in the corresponding holding gap 216 and stretches beyond the bottom surface of the receptacle insulating housing 21 for being soldered to the corresponding printed circuit board. The fixing portions 223 are fastened in the corresponding fixing grooves 217 so as to make the receptacle terminals 22 assembled in the receptacle insulating housing 21 firmly.

Figure 5:
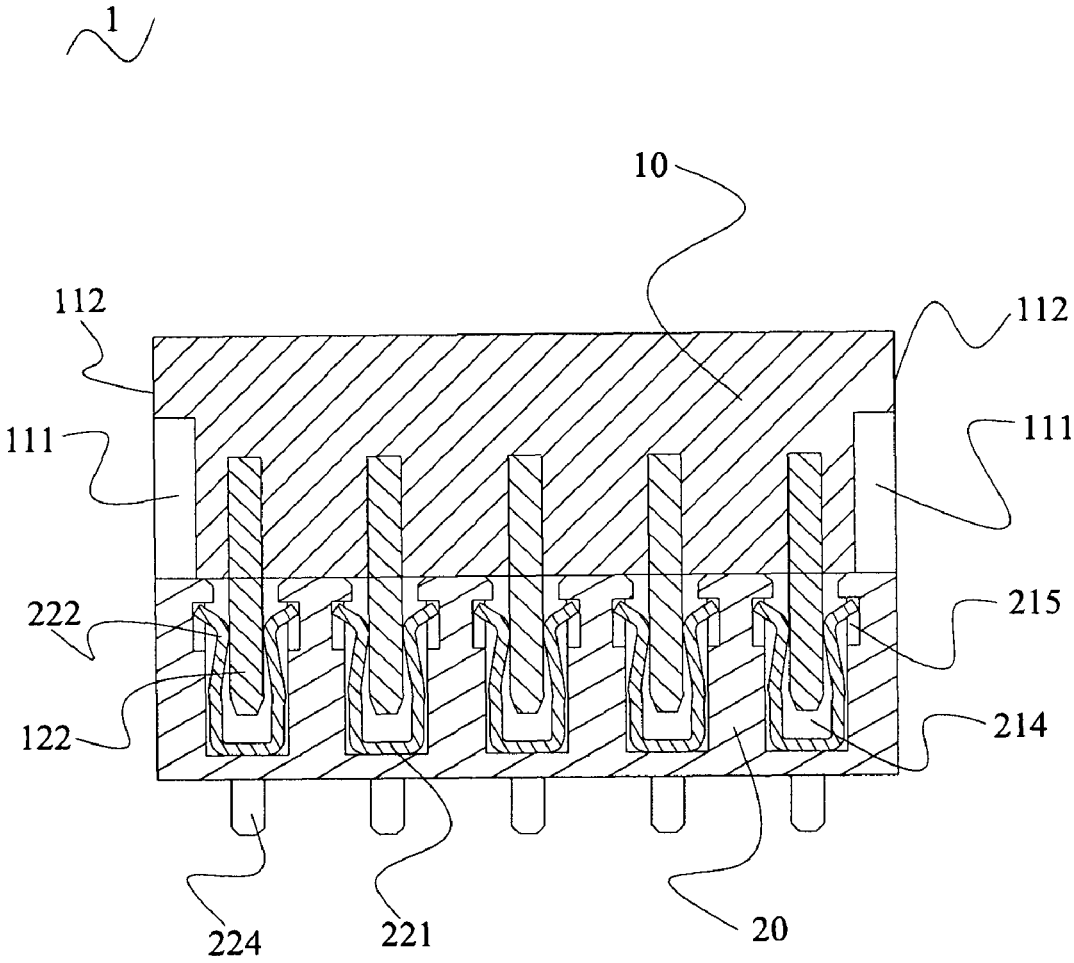
FIG. 5 is a cross-sectional view of the circuit board connector assembly of FIG. 1.

Referring to FIG. 1 and FIG. 5, when the two printed circuit boards respectively soldered with the corresponding receptacle connectors 20 are needed to transmit electrical signals with each other, the two receptacle connectors 20 are mated with the plug connector 10 respectively. One row of the contact arms 122 of the plug terminals 12 are electrically connected with the corresponding receptacle terminals 22 of one receptacle connector 20, and the other row of the contact arms 122 of the plug terminals 12 are electrically connected with the corresponding receptacle terminals 22 of the other receptacle connector 20, wherein each of the contact arms 122 is electrically clamped by the clamping portions 222 of the corresponding receptacle terminal 22. Therefore, the two receptacle connectors 20 are electrically connected with each other by the plug connector 10 so that the electrical signals can be transmitted between the two printed circuit boards. The two receptacle connectors 20 are arranged with inserting grooves 211 of the two receptacle insulating housings 21 opposite to each other. Moreover, the pair of buckling portions 114 is buckled into the corresponding inserting groove 211 so that remains a steady engagement of the plug connector 10 and the receptacle connectors 20.

When the receptacle connectors 20 are mated with the plug connector 10, the slope 115 can guide the corresponding buckling portion 114 to be easily buckled into and slide out from the corresponding inserting groove 211. Moreover, the operator can grapple the plug connector 10 by means of the assisting fillisters 111 so that facilitates the plug connector 10 to be pulled out of the receptacle connectors 20. The contact arm 122 of the plug terminal 12 is clamped by the clamping portions 222 of the corresponding receptacle terminal 22. As a result, it not only can prevent the signal transmission between the plug connector 10 and the receptacle connectors 20 from breaking off, but also can allow a certain offset between the two printed circuit boards.

As described above, each of the plug terminals 12 of the plug connector 10 has one pair of contact arms 122 electrically connecting corresponding two pairs of clamping portions 222 of the two receptacle connectors 20 so that the plug connector 10 need not to be soldered with the printed circuit board. When the circuit board connector, assembly 1 is broken, if the problem is checked out from the plug connector 10, the circuit board connector assembly 1 can be easily repaired due to the plug connector 10 without the printed circuit board soldered thereon so that simplifies repairing process.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A circuit board connector assembly, comprising:

two separate receptacle connectors disposed side by side, each including a receptacle insulating housing;

a plurality of receptacle terminals disposed in each of the receptacle insulating housing, each of the receptacle terminals having a base board, two opposite side edges of the base board extending towards a same direction to form a pair of clamping portions facing each other; and a plug connector mated with the two receptacle connectors and disposed on the top of the two adjacent receptacle connectors, the plug connector including:

a plug insulating housing being provided with four assisting fillisters at four side surfaces thereof respectively to facilitate the separation between the plug connector and the corresponding two receptacle connectors, two ends of each of two opposite side surfaces of the plug insulating housing extending downwardly to form a pair of buckling portions spaced away from each other, the receptacle insulating housing further defining an inserting groove located at the junction of a mating surface and a side surface thereof, the two receptacle connectors being arranged with inserting grooves of the two receptacle insulating housings opposite to each other, the buckling portions of the plug insulating housing being buckled into the corresponding inserting grooves of the two receptacle insulating housings; and a plurality of plug terminals, said plug terminals being integrated with the plug insulating housing, each of the plug terminals having a connecting board molded into the plug insulating housing, two opposite ends of the connecting board extending downwards towards a same direction to form a pair of contact arms spaced from each other and extending beyond a mating surface of the plug insulating housing to be electrically clamped by a corresponding two pairs of clamping portions of the two receptacle connectors, thereby providing a connection assembly for electrically connecting two circuit boards when the plug connector is mated with the said two corresponding separate receptacle connectors disposed side by side.

2. A circuit board connector assembly as claimed in claim 1, wherein an inner bottom corner of each of the buckling portions defines a slope.

3. A circuit board connector assembly as claimed in claim 1, wherein the pair of clamping portions of the receptacle terminal are face-to-face arched to approach each other so as to electrically clamp the corresponding contact arm of the plug terminal steadily.

4. A circuit board connector assembly as claimed in claim 1, wherein a free end of the base board of the receptacle terminal extends towards an opposite direction to the clamping portions to form a soldering portion stretches beyond a bottom surface of the receptacle insulating housing opposite to the mating surface thereof.

5. A circuit board connector assembly as claimed in claim 4, wherein the two opposite side edges of the base board of the receptacle terminal oppositely protrude to form a pair of fixing portions between the clamping portions and the soldering portion, the fixing portions are fastened in the receptacle insulating housing.

* * * * *